United States Patent [19]

Ashton

[11] Patent Number: 4,653,986

[45] Date of Patent: Mar. 31, 1987

[54] HYDRAULICALLY POWERED COMPRESSOR AND HYDRAULIC CONTROL AND POWER SYSTEM THEREFOR

[75] Inventor: Robert Ashton, Spring, Tex.

[73] Assignee: Tidewater Compression Service, Inc., Houston, Tex.

[21] Appl. No.: 854,714

[22] Filed: Apr. 16, 1986

Related U.S. Application Data

[63] Continuation of Ser. No. 518,003, Jul. 28, 1983, abandoned.

[51] Int. Cl.[4] ..... F04B 35/00

[52] U.S. Cl. ..... 417/243; 417/268; 417/390; 417/397

[58] Field of Search ..... 417/264, 267, 268, 274, 417/275, 276, 390, 397, 403, 404; 60/456; 91/305, 306, 313, 308, 291, 293, 301

[56] References Cited

U.S. PATENT DOCUMENTS

| | | | |
|---|---|---|---|
| 341,099 | 9/1886 | Dow | 417/243 |
| 678,487 | 7/1901 | Hill | 417/243 |
| 919,909 | 4/1909 | Meech | 417/397 X |
| 1,372,391 | 3/1921 | Barner | 417/397 X |
| 1,671,984 | 6/1928 | Goodman | 417/243 |
| 1,782,975 | 11/1930 | Schaer | 417/397 X |
| 1,952,690 | 3/1934 | Strom, Sr. | 91/308 |
| 2,203,832 | 6/1940 | Malburg | 417/242 |
| 2,440,614 | 4/1948 | Postel | 417/390 X |
| 2,479,856 | 8/1949 | Mitton . | |
| 3,084,847 | 4/1963 | Smith | 417/274 |
| 3,090,364 | 5/1963 | Lefevre | 91/313 X |
| 3,201,031 | 8/1965 | Maglott | 417/404 X |
| 3,295,452 | 1/1967 | Smith | 417/403 |
| 3,659,419 | 5/1972 | Ikeda | 60/456 X |
| 3,846,049 | 11/1974 | Douglas | 417/404 |
| 3,853,272 | 12/1974 | Decker et al. | 417/390 X |
| 3,890,782 | 6/1975 | Wauson | 60/327 |
| 4,255,091 | 3/1981 | Dike, Jr. | 417/63 |
| 4,334,833 | 6/1982 | Gozzi | 417/258 |
| 4,368,008 | 1/1983 | Budzich | 417/46 |
| 4,379,680 | 4/1983 | Barry | 417/403 |

FOREIGN PATENT DOCUMENTS

| | | |
|---|---|---|
| 64177 | 4/1982 | European Pat. Off. . |
| 1240274 | 7/1960 | France . |
| 1363990 | 8/1974 | United Kingdom . |

OTHER PUBLICATIONS

Catalog M-18L "The Big Haskeline".

Brochure entitled "Maximator Maximum Pressures".

Bode, D., "Hydraulically Operated Gas Compressor Unveiled" *Diesel & Gas Turbine World Wide*, May 1985.

Hydra-Comp Advertising Brochure, TIDE-AIR, Inc., Houston, Texas.

*Primary Examiner*—Leonard E. Smith

*Attorney, Agent, or Firm*—Nixon & Vanderhye

[57] ABSTRACT

A hydraulically powered compressor has infinitely variable capacity control through use of a variable displacement hydraulic pump, and a hydraulic control and power system provides the infinitely variable capacity control with a proportionate change in required power. Components may be mounted in an air duct.

32 Claims, 4 Drawing Figures

HYDRAULICALLY POWERED COMPRESSOR AND HYDRAULIC CONTROL AND POWER SYSTEM THEREFOR

This is a continuation application Ser. No. 518,003 filed July 28, 1983, now abandoned.

FIELD OF THE INVENTION

The invention relates to a hydraulically powered compressor, and hydraulic control and power system therefor, for elevating the pressure of gaseous substances, wherein infinitely variable capacity control is provided.

DESCRIPTION OF THE PRIOR ART

Prior art compressors for compressing gaseous substances, such as air, nitrogen or methane, to raise their pressure to a higher level, all suffer from one major disadvantage. Such prior art compressors do not provide infinitely variable capacity control with a proportionately variable horsepower requirement. Such prior art compressors have attempted to alleviate this disadvantage by utilizing various means of capacity control such as valve unloaders or variable or fixed volume pockets. These types of capacity controls are limited in range. Valve unloaders provide large capacity changes or capacity "spikes". Compressors driven by reciprocating engines or turbines provide smooth capacity control over a portion of the speed range of the engine or turbine, but the engine or turbine cannot normally be used to operate the compressor when the speed of the engine or turbine falls below 50% of its maximum speed. In situations such as when a compressor is being utilized to compress and elevate the pressure of natural gas flowing from a wellhead, the flow conditions of the gas which is entering the compressor may vary widely. If small volumes of flowing gas are entering the compressor, it is necessary for the compressor to operate very slowly in order to act upon the natural gas to raise it to the desired pressure. Conversely, if a large volume of natural gas is naturally flowing from the wellhead, the compressor must operate more quickely to compress the larger volume of natural gas to the desired elevated pressure. Thus, it would be very desirable to have a compressor which is operable at an infinitely variable speed, so as to be able to be operable over a wide range of incoming gas flow conditions.

Other disavantages associated with prior art compressors are that they are extremely complicated in their design and manufacture, thus increasing the cost associated with manufacturing and servicing such compressors. Particularly in the case of compressors which may be utilized at remote wellhead locations, it is important that the compressor may be readily serviced and repaired. Further, many prior art compressors provide cooling for the compressor assembly, which cooling is provided by a water jacket. Thus, such compressors require a source of water or a closed cooling system in order to dissipate the heat caused by the compression of the gaseous substance. Such a water source may be unavailable at many remote locations. Additionally, such compressors require additional components, such as water pumps which are readily susceptible to maintenance problems.

Accordingly, prior to the development of the present invention, there has been no hydraulically powered compressor or hydraulic control and power system therefor, which: provides infinitely variable capacity control; with a proportionately variable horsepower requirement is efficient and economical in its design; is readily serviced and repaired; and does not require water cooling. Therefore, the art has sought a hydraulically powered compressor, and hydraulic control and power system therefor, which: provides infinitely variable capacity control; is efficiently and economically manufactured; is easily readily repaired and serviced; and is air cooled.

SUMMARY OF THE INVENTION

In accordance with the invention the foregoing advantages have been achieved through the present hydraulically powered compressor and hydraulic control and power system therefor. The present invention includes: a first double-acting piston and compression cylinder for initially compressing the gaseous substance; second double-acting piston and compressor cylinder for additional compression of the gaseous substance; a hydraulic power piston and cylinder disposed between the first and second double-acting pistons and cylinders; the first and second double-acting pistons and the hydraulic powered piston each being disposed on a common elongate piston rod; first piping for transferring the compressed gaseous substance from the first piston and compression cylinder to the second piston and compression cylinder; second piping for transferring the compressed gaseous substance from the second piston and compression cylinder to an exit orifice; first and second cooling coils respectively associated with the first and second piping for cooling the compressed gaseous substance; means for forcing air to flow over the first and second cooling coils; the first and second pistons and compression cylinders, power piston and cylinder, first and second piping, first and second cooling coils, and air forcing means, all being disposed within an air-cooling duct to provide cooling thereto; and means for providing infinitely variable capacity control for the first and second pistons and compression cylinders, the capacity control means including a variable displacement hydraulic pump for actuating the hydraulic power piston and cylinder, whereby the first and second pistons and compression cylinders may be operated over a range of 0 to 100% of their capacity with a proportionately variable power requirement.

Another feature of the present invention is that the means for forcing air includes a fan and a hydraulic motor therefor, the motor having a pressure compensated flow control valve associated therewith, and the valve is associated and disposed between the variable displacement hydraulic pump and the motor, whereby the fan operates at a constant speed to provide cooling to the first and second cooling coils, first and second pistons and cylinders and hydraulic power piston and cylinder and to blow out of the air cooling duct any accumulated gaseous substances. An additional feature of the present invention is that a cooling chamber is provided between the hydraulic power piston and cylinder and each of the first and second pistons and cylinders, each cooling chamber surrounding a portion of the piston rod and including means for directing air flow from the means from forcing air over the piston rod.

A further feature of the present invention is that the first and second pistons and compression cylinders and hydraulic power piston and cylinder are disposed on a mounting plate by means of two mounting bolts, whereby transmission of stress forces to the compression cylinders and power cylinder from the mounting plate deflection is greatly minimized. An additional feature of the present invention is that the first and second pistons are threadedly affixed in a first direction to the piston rod and are secured to the piston rod by a locking member which is threaded into the piston rod in a second opposite direction.

The present invention further includes a hydraulic control and power system for a compressor for gaseous substances which compressor has first and second double-acting pistons and compression cylinders and a reciprocating hydraulic power piston and cylinder for actuating the first and second pistons, which includes: a variable displacement hydraulic pump for providing hydraulic fluid to the power piston and cylinder to reciprocate the power piston within its cylinder; a shuttle valve for alternating the flow of hydraulic fluid from the pump into and out of the ends of the hydraulic power piston cylinder; a cam-operated, spring loaded check valve associated with each end of the power piston cylinder, the check valves being actuated by the reciprocating motion of the power piston to discharge hydraulic fluid from the respective end of a pilot valve; a pilot valve for actuating the shuttle valve in response to a pressure differential caused by the discharge of hydraulic fluid through one of the cam-operated, spring loaded check valves; a hydraulic fluid resevoir; and hydraulic fluid piping operatively associating the pump, shuttle valve, check valves, pilot valve, and resevoir with one another, whereby upon varying the displacement of the pump, the speed of reciprocation of the power piston is varied.

A further feature of the present invention is that a flow control valve may be operatively associated with each end of the shuttle valve to throttle the hydraulic fluid flowing from the pilot valve to either end of the shuttle valve, whereby the reciprocating speed of the shuttle valve is controlled and hydraulic shocks caused by the shuttle valve reciprocating too quickly are controlled. An additional feature of the present invention is that the ball check valves and fluid control valves may be each operatively associated with a needle valve for creating a pressure differential to reciprocate the pilot valve.

An additional feature of the present invention is that a pressure relief valve may be operatively associated with the pump, whereby an excessive pressure build-up within the piping or either compression cylinder is safely relieved. Another feature of the present invention is that a pressure compensated flow control valve and distribution block may be operatively associated with the pump and piping to provide lubricating hydraulic fluid to the compression cylinders and piston rod for the double-acting piston.

The hydraulically powered compressor, and hydraulic control and power system therefor, of the present invention, when compared with previously prior art compressors has the advantages: of providing infinitely variable capacity control; with directly associated power requirement is efficiently and economically manufactured; is readily repaired and serviced; and provides air cooling of the various components of the compressor.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
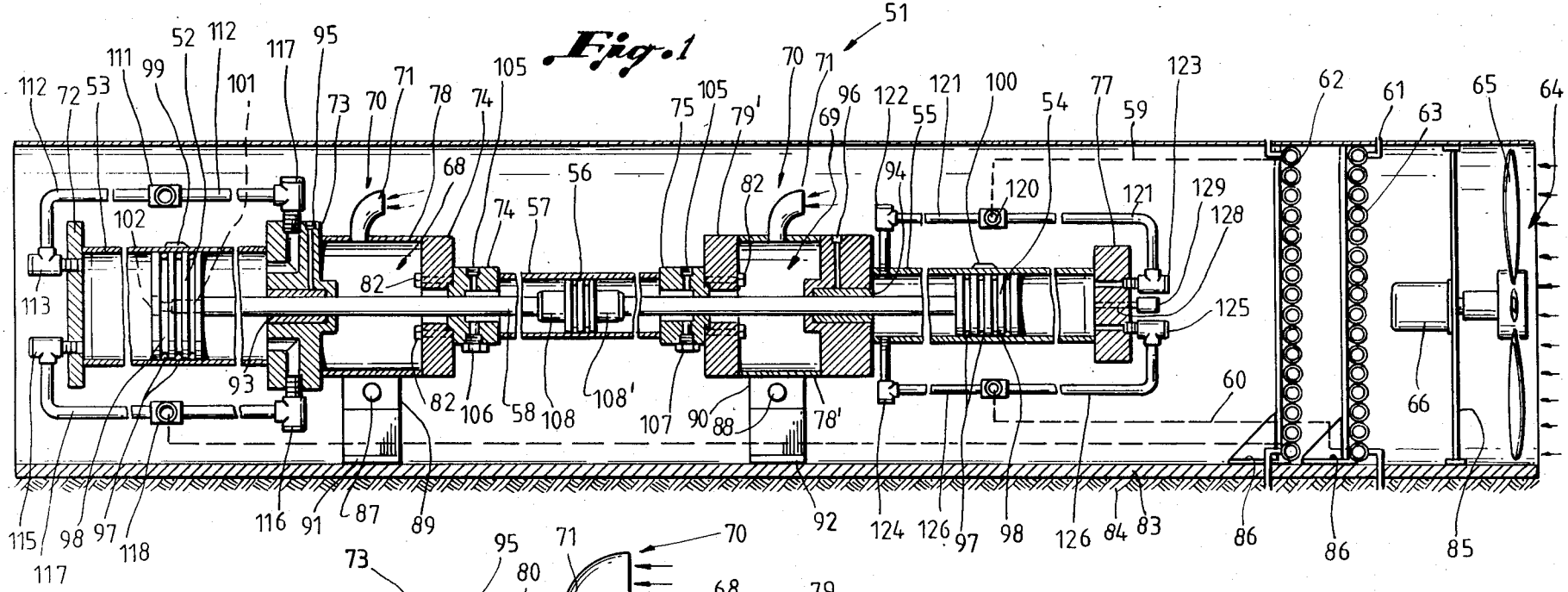
FIG. 1 is a partial cross-sectional view along the longitudinal axis of a compressor in accordance with the present invention.

In FIG. 1, the hydraulically powered compressor 51 of the present invention for elevating the pressure of gaseous substances, such as air, nitrogen, or methane is shown. Compressor 51 generally includes a first double-acting piston 52 and compression cylinder 53 which initially compress the gaseous substances (not shown), as will be hereinafter described; a second double-acting piston 54 and compression cylinder 55 which provide the second stage of compression, as will be hereinafter described; and a hydraulic power piston 56 and cylinder 57, which power piston 56 and cylinder 57 are disposed between the first and second double-acting pistons 52, 54 and cylinders 53, 55. As seen in FIG. 1, the first and second double-acting pistons 52, 54 and the hydraulic power piston 56 are each mounted upon a common elongate piston rod 58, whereby the longitudinal axes of the cylinders 53, 55, 57, are alligned axially. The foregoing described components of compressor 51 may be manufactured of any suitable material having the requisite strength characteristics; however, for ease of assembly and economy in manufacture, cylinders 53, 55, and 57 are preferably manufactured from commercially available drawn-over mandrel steel tubing, which is readily and economically available. As is customary in the design of two-stage compressors, the diameter of the second compression cylinder 55 is smaller than that of the first compression cylinder 53, in order to provide for the second stage of compression of the gaseous substance. Of course, if desired, the diameter of the second compression cylinder 55 could be the same as the diameter of the first compression cylinder 53, in order to provide a one-stage compressor. Suitable piping connections would be provided whereby the inlet gaseous substance enters both cylinders simultaneously via a common inlet manifold and the compressed gas exits into a common discharge manifold into the cooling means to be hereinafter described. Likewise, by use of steeple design cylinders, up to four stages of compression could be obtained.

Still with reference to FIG. 1, it is seen that compressor 51 of the present invention also generally includes first piping 59 (for ease of illustration, shown in dotted lines) for transferring compressed gas from the first piston and compression cylinder 52, 53 to the second piston and compression cylinder 54, 55. Second piping 60 (also shown in dotted lines for ease of illustration) is provided for transferring compressed gas from the second piston and compression cylinder 54, 55 to an exit orifice, shown generally at 61. It should be understood that upon the gaseous substance being compressed and elevated to an increased pressure, the gaseous substance exiting compressor 51 at exit orifice 61 may be piped to whatever location and/or use is desired, such as a storage tank, or pipe line, etc.

With reference to FIG. 1, it is seen that there are first and second cooling coils 62, 63 associated with the first and second piping 59, 60 for cooling the compressed gaseous substance. As seen in FIG. 1, first cooling coil, or intercooler, 62 is disposed intermediate the ends of first piping 59, and the second cooling coils, or aftercooler, 63 is disposed intermediate the ends of second piping 60. Compressor 51 is further provided with a means for forcing 64 air to flow over the first and second cooling coils 62, 63. Preferably the means for forcing air 64 includes a plurality of fan blades 65, which are rotated by a hydraulic motor 66. Of course, additional cooling coils could be provided, if necessary, as well as a thermostat to control the operation of the fan dependent upon ambient temperatures. As seen in FIG. 1 the first and second pistons and compression cylinders 52–55, power piston and cylinder 56, 57, first and second piping 59, 60, first and second cooling coils 62, 63, and air forcing means 64 are preferably disposed within an air-cooling duct 67, which extends the length of compressor 51. Air-cooling duct 67 may be manufactured of any suitable material, such as sheet metal, and may have any suitable cross-sectional configuration, such as circular, U-shaped or square, etc., so long as it serves to confine the air flow generated by air forcing means 64 to pass across cooling coils 62 and 63 and the other components of compressor 51. Should any leaks develop in compressor 51, the constant air flow from fan blades 65 will exhaust any accumulation of gas.

Air-cooling duct 67 also serves the function of protecting the various components of compressor 51 from the elements and adverse environmental conditions. Thus, upon hydraulic fluid being supplied to hydraulic motor 66 of air forcing means 64, fan blades 65 will be caused to rotate and will suck air into air-cooling duct 67, which air will pass over cooling coils 62 and 63, as well as pass from right to left as shown in FIG. 1, down air-cooling duct 67 over all of the other components of compressor 51. Thus, as gas which has been compressed in the first stage piston and compression cylinder 52, 53 passes down piping 59 to intercooler 62, air flow from fan blades 65 will dissipate the heat in the gas caused by its compression thereof as the gas flows through intercooler 62 and aftercooler 63.

Figure 2:
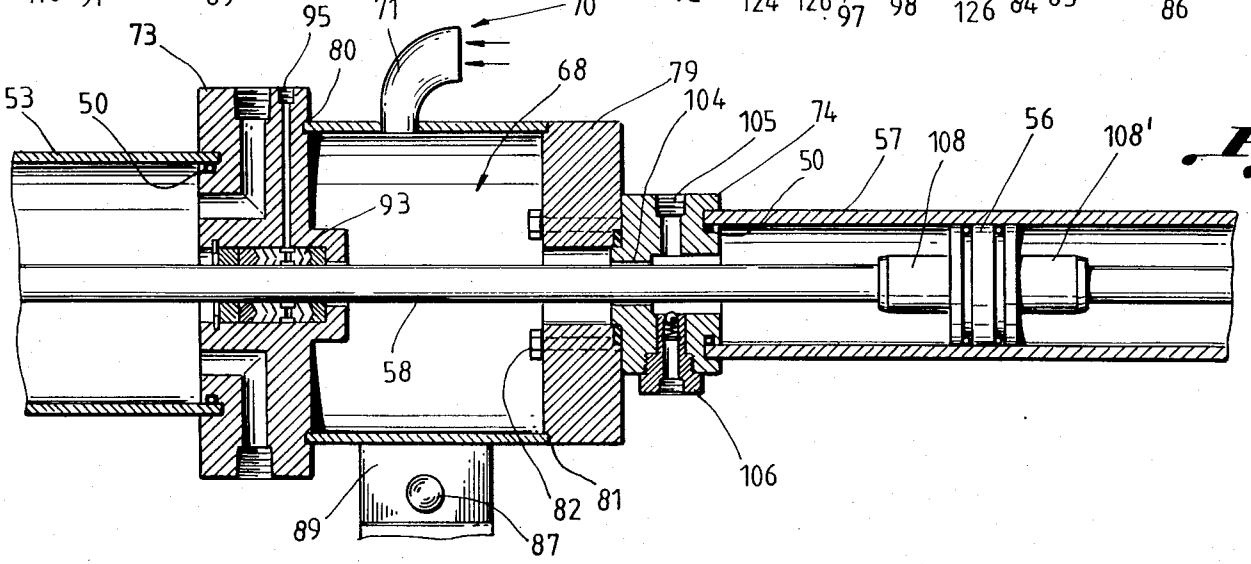
FIG. 2 is an enlarged, partial cross-sectional view along an examplary axis of a compressor in accordance with the present invention.

With reference to FIGS. 1 and 2, it is seen that compressor 51 is provided with cooling chambers 68, 69. Cooling chamber 68, with particular reference to FIG. 2, is disposed between first-stage piston and cylinder 52, 53 and hydraulic power piston and cylinder 56, 57; and cooling chamber 69 is disposed between hydraulic power piston and cylinder 56, 57 and second stage piston and cylinder 54, 55. The cooling chambers 68, 69 each surround a portion of piston rod 58 and include means for directing to air flow, from the means for forcing air 64, over piston rod 58. Preferably, the means for directing air flow 70 comprises a pipe elbow, or duct, 71, which directs air from fan blades 65 to flow inwardly into cooling chambers 68 and 69. Cooling chambers 68, 69 each have suitable openings (not shown) to allow the air from ducts 71 to be vented out of the cooling chambers 68, 69. Thus, additional heat generated during operation of compressor 51 may be dissipated via convection in cooling chambers 68, 69.

Still with reference to FIGS. 1 and 2, it is seen that each cylinder 53, 55 and 57, is provided with first and second cylinder header members. First stage cylinder 53 is provided with first and second header members 72, 73; hydraulic cylinder 57 is provided with first and second header members 74, 75; and second stage compression cylinder 55 is provided with first and second header members 76, 77. Each set of header members and compression cylinders 72, 73, 53; 74, 75, 57; and 76, 77, and 55, are held together by a plurality of elongate tie rods (not shown for clarity of illustration purposes) whereby the various components of compressor 51 may be readily assembled and disassembled for servicing. As shown in detail in FIG. 2, each cylinder end is sealed against its respective header members by an O-ring seal 50 which contacts the inner surface of each cylinder. Accordingly, the amount of surface area of each header member upon which gas pressure acts upon is reduced, whereby the stresses on the connecting tie rods for each set of header members is likewise reduced.

With reference to FIGS. 1 and 2, it is seen that cooling chambers 68, 69 are formed by an outer housing member 78, 78' and header members 79, 79'. Housings 78, 78' may have any cross-sectional configuration; however, housing members 78, 78' preferably have a circular cross-sectional configuration. Housing member 78 is received into header member 73 as by groove 80, as seen in FIG. 2, and is received into header member 79 as shown at 81. The construction of housing member 78' and header member 79' is the same as that previously described for housing member 78 and header member 79. Further with reference to FIGS. 1 and 2, it is seen that header members 79, 79' are attached to header members 74, 75 of power cylinder 57, as by a plurality of bolts, or tie rods, 82.

Still with reference to FIGS. 1 and 2, it is seen that all the previously described components of compressor 51 are disposed upon a mounting plate 83 which rests upon the earth's surface 84 or any other suitable structure, such as a portable skid. Air forcing means 64 is fixedly secured to mounting plate 83 as by a vertical brace 85, and cooling coils 62, 63 are provided with any suitable base members 86 which are secured to mounting plate 83 in any conventional manner. The first stage piston and cylinder 52, 53, second stage piston and cylinder 54, 55, and the hydraulic power piston and cylinder 56, 57 are disposed on mounting plate 83 via two bolts 87, 88 which pass through depending flanges 89, 90 affixed to housing members 78, 78' of cooling chambers 68, 69, which flanges 89, 90 are received in mounting lugs 91 and 92 secured to mounting plate 83. Accordingly, the foregoing compressor components of compressor 51 have a two-point mounting system, whereby transmission of stress forces to the compression cylinders 53, 55 and power cylinder 57 from the mounting plate 83 is greatly minimized. This two-point mounting system allows a certain amount of flexing and movement between the various components of compressor 51, which is not detrimental to the operation of compressor 51, and provides for a very simple, economical, and efficient system for mounting the various components of compressor 51 to mounting plate 83.

As shown in FIG. 1, and particularly in FIG. 2, both the first stage cylinder 53 and second stage cylinder 55 are sealed where piston rod 58 enters cylinders 53 and 55. A rod packing 93 is provided in header member 73, and an identical rod packing 94 is provided in header member 76. Header members 73 and 76 are each provided with a lubrication connection passageway, or duct 95, 96 which are in fluid transmitting relationship to rod packings 93 and 94 to lubricate the packings 93 and 94 and the packing housing which also support the piston rod 58. The transmission of the hydraulic, lubrication fluid through ducts 95, 96 will be hereinafter described with reference to FIG. 3.

With reference to FIG. 1, the construction of the first and second stage pistons 52, and 54 will be described. Pistons 52 and 54 are sealed against the interior surface of cylinders 53, 55 by a plurality of polytetrafluoroethylene (PTFE) piston rings 97 which are mounted in a plurality of groove 98 formed in the outer surface of pistons 52, 54. The PTFE rings 97 support pistons 52 and 54 within cylinders 53, 55, whereby the outer surface of pistons 52, 54 do not contact the interior surface of cylinders 53, 55. Accordingly pistons 52 and 54 may be reciprocated within the cylinders 53, 55 without any lubrication being provided to cylinders 53, 55. If compressor 51 is being utilized to compress and elevate the pressure of certain types of wet gaseous substances, wherein lubication is desired within the first and second stage pistons and cylinder-52–55, hydraulic lubricating oil can be provided via lubrication connections 99 for cylinder 53 and 100 for cylinder 55. Suitable piping (not shown) is provided for transmitting the hydraulic fluid to the lubrication connections 99, 100, as will be hereinafter described with regard to FIG. 3.

An important safety feature of the present invention is that pistons 52, 54 are fixedly secured to piston rod 58 as by a threaded connection 101 (for ease of description, the threaded connection for piston 52 is illustrated and it is identical to that utilized for piston 54). Preferably, threaded connection 101 has a first thread direction, preferably as by right-hand threads. A locking member, or socket head cap screw, 102 is threadedly received into the outer surface of piston 52 until it engages the end of piston rod 58. Locking member 102 is threaded through piston 52 into piston rod 58 in a second opposite direction. Locking member 102 and its mating surface in piston 52 is preferably provided with left-hand threads. Accordingly, the possiblity of the pistons 52, 54 becoming disengaged from piston rod 58 from vibrational forces is greatly reduced. Since severe damage to compressor 51 and/or personnel in the vicinity of compressor 51 can result when a piston comes loose from piston rod 58, the safety aspects of compressor 51 are greatly enhanced.

Hydraulic power piston 56 is likewise provided with suitable seals 103 disposed in grooves in the outer surface of piston 56, in a manner similar to pistons 52 and 54. It should be noted that if no lubrication fluid is fed through lubrication connections 95 and 96 for piston rod packing 93 and 94, adequate lubrication oil will be suppled by hydraulic fluid left on piston rod 58 as piston rod 58 reciprocates past the seals 104 for power cylinder 57 disposed in header members 74 and 75.

With reference to FIGS. 1 and 2, the piping and valving connections for the hydraulic fluid (not shown) of compressor 51 will be described. Hydraulic power piston and cylinder 56, 57 are provided with hydraulic fluid feed and discharge ports 105 disposed in power cylinder header members 74, 75. Ball check valves 106 and 107 are alternately opened upon power piston 56 being reciprocated within cylinder 57. With particular reference to FIG. 2, it is seen that power piston 56 includes tubular camming members 108 and 108′ disposed on either side of piston 56. As piston 56 reciprocates within cylinder 57, camming member 108 will engage and open cam-operated, spring loaded ball check valve 106, and camming member 108′ will likewise engage and open the other check valve 107, as will be hereinafter described in greater detail. The opening of the cam-operated check valves 106, 107 create a pressure differential to reciprocate pilot valve 133 to be hereinafter described.

Figures 3, 4:
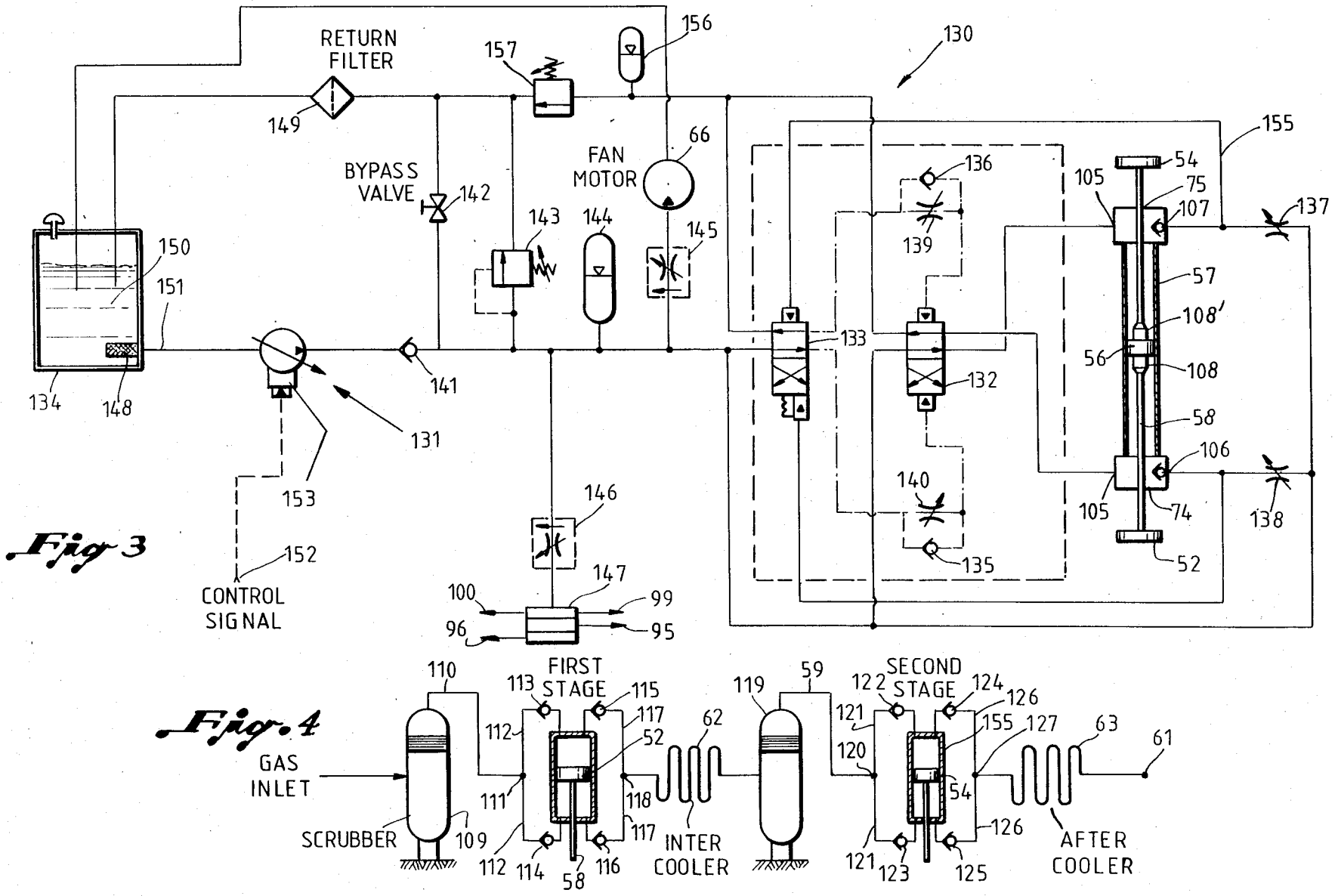
FIG. 3 is a schematic hydraulic flow diagram of the hydraulic control and power system in accordance with the present invention.
FIG. 4 is a schematic flow diagram of the gaseous substance to be compressed in accordance with the present invention.

With reference to FIGS. 1 and 4, the flow diagram for the gaseous substance to be compressed will be described in greater detail. The gaseous substance to be compressed, which may come from a wellhead, storage tank, etc., may first pass through a conventional, optional scrubber unit 109, as seen in FIG. 4. From the scrubber unit 109, the gas passes via piping (shown schematically as 110 in FIG. 4) into the first compressor stage cylinder 53 via inlet manifold 111, which distributes the gas through piping 112 to two inlet ball check valves 113, 114 disposed in header members 72, 74. Reciprocation of hydraulic power piston 56, as will be hereinafter described, causes piston 52 to reciprocate within first stage cylinder 53 which alternately sucks gas through inlet check valves 113, 114 and compresses the gas within cylinder 53 on both sides of piston 52. The compressed gas is then discharged from first cylinder 53 through discharge check valves 115, 116 which are likewise mounted in header members 72, 73. Discharge check valves 115, 116 feed into piping 117 into discharge manifold 118 and into first piping 59 as previously described. The compressed gas then passes through intercooler 62 through first piping 59 into another optional scrubber unit 119 as shown in FIG. 4. It should be noted that optional scrubber units 109 and 119 would be disposed outside of air-cooling duct 67; and would be provided with suitable, conventional piping connections. After the gas has been first compressed in the first stage, cooled, and then optionally scrubbed, it passes through first piping 59 into the second stage inlet manifold 120, through piping 121, and past second inlet ball check valves 122, 123 and the gas is compressed within the second stage cylinder 55 in the same manner as occured in the first stage cylinder 53. The gas is then discharged through second stage discharge check valves 124, 125 into piping 126 and discharge manifold 127. The compressed gas then passes through second piping 60 into aftercooler 63 and to exit orifice 61, as previously described. It should be noted that at least one of the compression cylinders 53, 55 may be provided with a clearance bottle 129 which may be associated with a pipe-tapped opening as at 128 in header 77, whereby the clearance volume of second stage compressor cylinder 55 is variable to provide for balancing compression ratios between the first and second compression cylinders 53, 55. It should be noted that header 72 of the first stage compression cylinder 53 may likewise be provided with a similar pipe-tapped opening such as 128, with a similar clearance bottle 129.

Turning now to FIG. 3, the hydraulic control and power system for compressor 51 will be described. It should first be noted that the components to be hereinafter described, with the exception of the hydraulic power piston and cylinder 56, 57, may be disposed within air-cooling duct 67 if space permits, or may be disposed adjacent to compressor 51 on any suitable base member or skid. In general, the hydraulic control and power system 130 includes the following components: a variable displacement hydraulic pump 131; a shuttle valve 132: cam-operated, spring loaded check valves 106, 107, as previously described; hydraulic power piston and cylinder 56, 57, as previously described; pilot valve 133; hydraulic fluid reservoir 134; flow control valves 135, 136, operatively associated with each end of shuttle valve 132; needle valves 137–140; ball check valve 141; manual bypass valve 142; relief valve 143; bladder accumulator 144; pressure compensated control valves 145, 146; a hydraulic distribution block 147; hydraulic feed ports 105, as previously described; hydraulic fluid filters 148, 149; bladder accumulator 156; and back pressure control valve 157. Hydraulic fluid piping as shown throughout FIG. 3 is further provided which operatively associates pump 131, shuttle valve 132, check valves 106, 107, pilot valve 133, resevoir 134, and the other components of hydraulic control and power system 130 to each others as will be hereinafter described in greater detail.

Hydraulic oil 150 is stored in reservoir 134 and is drawn into the variable displacement hydraulic pump 131 through suction screen 148 and piping 151 upon the actuation or starting of pump 131. Suction screen 148 serves to prevent any impurities from entering the hydraulic control and power system 130. Pump 131 is controled via a control signal 152 being applied to pump actuator head 153. The control signal may be from any conventional generating source, that is it can be electrically, mechanically, pneumatically, or otherwise generated. Pump 131 is initially destroked to zero flow by venting the control signal 152 operating on actuator head 153. After a period of warm up time, the control signal 152 is restored to pump actuator head 153, and pump 131 increases in stroke in response to the increasing control signal on actuator head 153. Accordingly, flow of hydraulic fluid 150 through system 130 commences and the pressure of the hydraulic fluid 150 throughout system 130 increases to the necessary pressure to overcome the pressure loads on the first stage and second stage pistons 52, 54 due to the presence of a gaseous substance within compression cylinders 53, 55. It should be noted that by increasing the control, or pressure, signal 152 to pump actuator head 153, the flow of hydraulic fluid throughout the hydraulic control and power system 130 is increased, which in turn increases the cycling, or reciprocation, speed of power piston 56. This increased speed in turn increases the capacity, or ability, of compressor 51 to compress increased volumes of inlet gas with an associated increase in required horsepower. Likewise, by decreasing the pressure, or control signal, 152 upon pump actuator head 153 the speed of the hydraulic control and power system 130 is slowed down, which in turn allows compressor 51 to slow down to accommodate decreased volumes, or a lower capacity, of incoming gas with an associated increase in required horsepower. Accordingly, the hydraulic control and power system 130 of the present invention allows compressor 51 to operate over an infinitely variable speed range to provide infinitely variable capacity control of compressor 51. If the incoming flow and pressure conditions into the first stage compressor cylinder 53 vary, it is merely necessary to change the control signal 152 to the variable displacement pump 131 in order to compensate for the changing incoming pressure and flow conditions of the gaseous substance. The power source for variable displacement pump 131 may be of any conventional type, including a constant speed electric motor, a reciprocating engine, or any other suitable rotating power source. It should be understood that with a variable displacement pump, the power source speed can remain constant and its horsepower requirements to operate the pump vary proportionately with the flow of the pump. Thus, when compressor 51 operates upon gas flowing under decreased flow conditions, e.g. a lower capacity, energy is conserved because the horsepower requirements from the power source are likewise proportionately decreased. The variable displacement hydraulic pump 131, controlled as described in the preceding paragraph, inherently provides constant output throughout the reciprocatory cycle of the reciprocatory hydraulic power piston 56.

Still with reference to FIG. 3, it is seen that hydraulic fluid 150 exits from variable displacement pump 131 from its exit orifice as shown at 154 and passes through ball check valve 141, or other suitable valve. Ball check valve 141 prevents hydraulic fluid pressure backing up upon pump 131 and from reversing the hydraulic fluid flow and draining the hydraulic fluid 150 in the pump 131 when pump 131 is turned off. It should be noted that pressure relief valve 143, is of conventional manufacture and protects all the hydraulic components of system 130 from an excessive pressure build-up within the hydraulic piping or compression cylinders 53, 55, whereby such excessive pressure build-ups may be safely relieved through relief valve 143. Additionally, pressure relief valve 143 allows compression cylinders 53 and 55 to have liquid substances pass therethrough without damage to the compression cylinders 53, 55. It is not unusual for a compressor working upon well head natural gas to have liquids from the wellhead flowing in the gas stream. This situation is commonly called "liquid slugging", and such liquid "slugs" flowing in a gas stream into a compressor can cause serious damage to the compressor cylinders due to the increased pressure build-up when such liquid "slugs" enter the compression cylinders.

As seen in FIG. 3, hydraulic system pressure acts upon the cam-operated, spring loaded check valves 106, 107 across needle valves 137, 138, whereby check valves 106 and 107 are normally maintained in a closed position until opened by tubular camming members 108, 108'. Hydraulic power piston 56 moves to the right toward ball check valve 107 until the camming member 108' opens ball check valve 107 to release the hydraulic fluid pressure through hydraulic fluid feed port 105 and header member 75. The opening of ball check valve 107 thus vents the hydraulic fluid at the end of pilot valve 133 to the reservoir 134 via piping 155. The venting of hydraulic fluid previously described creates a pressure differential across four-way pilot valve 133 and thus strokes it to apply system pressure to the opposite end of the four-way shuttle valve 132. Simultaneously therewith, the formerly pressurized end of the shuttle valve 132 is vented through the pilot valve 133 to the reservoir 134, as shown in FIG. 3. The shifting of the shuttle valve 132 causes hydraulic fluid 150 to be alternately applied to, and exhausted from, the hydraulic fluid feed ports 105 in headers 74, 75, which cause power piston 56 to reciprocate within cylinder 57. Flow control valves 135 and 136 control the speed at which the shuttle valve 132 moves by throttling the hydraulic fluid 150 flowing from the pilot valve 133 to the ends of the shuttle valve 132, whereby hydraulic shocks, caused by the switching of the shuttle valve 132 too quickly are dampened. It should be noted that flow control valves similar to valves 135, 136 could also be operatively associated with the ends of pilot valve 133 to further control the switching response of the hydraulic components of system 130. It should be noted that pilot valve 133, shuttle valve 132, and flow control valves 135, 136 are conventional, commercially available valves. Oil exhausted from four-way shuttle valve 132 is discharged in a pulsating manner. These pulsations which could be harmful to the hydraulic system components are effectively dampened using accumulator 156 in association with back pressure control valve 157 assuring long system component life. Four-way pilot valve 133 incorporates a mechanical latching mechanism or detent which locks the pilot "valve spool" 133 in position when system flow is interrupted. Without this feature the pilot valve spool 133 could seek a neutral position in the valve body so that compressor 51 could not be started.

Still with reference to FIG. 3, it is seen that pressure compensated control valve 146 may also be operatively associated with pump 131 to meter hydraulic fluid 150 to distribution block 147. Distribution block 147 thus meters exact volumes of hydraulic fluid 150, if desired, to the first and second stage cylinder lubrication connections 99, 100, and to the rod packing lubrications 95, 96. Manual bypass valve 142 may be provided to manually unload the pressure in pump 131 if desired. Bladder accumulator 144 may be also operatively associated with pump 131 and system 130 to reduce system pulsations or pressure shocks when the shuttle valve 132 switches. Bladder accumulator 144 also serves the function of storing and conserving hydraulic energy within system 130 when switching of shuttle valve 132 occurs.

As previously described, the motor 66 for fan blade 65 is hydraulically operated, and its speed is controlled by a pressure compensated flow control valve 145. Once valve 145 is set to the desired pressure rating, the speed of fan motor 66, and in turn the rotation of the fan blades 65 will remain constant even though there are hydraulic system pressure changes in the system 130. In this regard it should be noted that the fan speed can be varied by adjusting the pressure compensated control valve 145 in order to control varying temperature conditions caused by increased ambient temperature conditions at the location of compressor 51, or from increased temperature conditions caused by the incoming gaseous substance into compressor 51.

Each of the ball check valves 106 and 107 and fluid control valves 135 and 136 may be operatively associated with needle valves 137–140 for varying the flow to such valves to vary the response time of such valves. It should be readily apparent to one of ordinay skill in the art that two compressors 51 of the present invention could be connected in series, one along side each other with suitable piping connections there between, to provide a four-stage compressor.

It is to be understood that the invention is not limited to the exact details of construction, operation, exact materials, or embodiment shown and described, as obvious modifications and equivalents will be apparent to one skilled in the art; for example, the intercooler and after cooler and air forcing means could be utilized as a separate, skid-mounted unit, of a larger size should additional cooling of the compressed gas be necessary. Accordingly, the invention is therefore to be limited only by the scope of the appended claims.

What is claimed is:

1. A hydraulically powered compressor for elevating the pressure of gaseous substances, comprising;

a first double-acting piston and compression cylinder for initially compressing the gaseous substance;

a second double-acting piston and compression cylinder for additional compression of the gaseous substance;

a hydraulic power piston and cylinder disposed between the first and second double-acting pistons and cylinders; the first and second double acting pistons and the hydraulic power piston each being disposed on a common elongate piston rod;

first piping for transferring the compressed gaseous substance from the first piston and compression cylinder to the second piston and compression cylinder;

second piping for transferring the compressed gaseous substance from the second piston and compression cylinder to an exit orifice;

first and second coils respectively associated with the first and second piping for cooling the compressed gaseous substance; means for forcing air to flow over the first and second cooling coils;

the first and second pistons and compression cylinders, power piston and cylinder, first and second piping, first and second cooling coils, and air forcing means are all disposed within an air-cooling duct to provide cooling thereto; and means for providing infinitely variable capacity control with a proportionately variable power requirement for the first and second pistons and compression cylinders, such means including a variable displacement hydraulic pump means for actuating the hydraulic power piston and cylinder so that the first and second pistons and compression cylinders may be operated over a range of from 0 to 100% of their capacity, with a proportionately variable power requirement.

2. The compressor of claim 1, wherein the first and second pistons and compression cylinders and hydraulic power piston and cylinder are disposed on a mounting plate by means of two mounting bolts, whereby transmission of stress forces to the compression cylinders and power cylinder from the mounting plate is greatly minimized.

3. The compressor of claim 1, wherein the first and second pistons are threadedly affixed in a first direction to the piston rod and are secured to the piston rod by a locking member which is threaded into the piston rod in a second opposite direction.

4. The compressor of claim 1, wherein the means for forcing air includes a fan and hydraulic motor therefor, and the motor has a pressure compensated flow control valve associated therewith operatively connected between the variable displacement hydraulic pump and the motor, so that the fan motor is powered by the variable displacement hydraulic pump, and operates at a constant speed to provide cooling to the first and second cooling coils, first and second pistons and cylinders, and hydraulic power piston and cylinder and to blow out of the air cooling duct any accumulated gaseous substance.

5. The compressor of claim 1, wherein the piston rod is provided with a plurality of rod packings and the variable displacement hydraulic pump is associated therewith to automatically provide lubricating hydraulic oil thereto.

6. The compressor of claim 1, wherein the first and second cylinders are provided with lubrication connections associated with the first and second pistons and the variable displacement hydraulic pump, whereby lubricating hydraulic oil is automatically provided to the interface between the first and second pistons and first and second compression cylinders.

7. The compressor of claim 1, wherein each of the first and second cylinders and the hydraulic power cylinder each engage a header member at the first and second ends of each cylinder, and a seal means is provided on each header member which seal means contacts the internal surface of each cylinder.

8. The compressor of claim 1, wherein a pressure relief valve means associated with the hydraulic variable displacement pump and first and second compression cylinders, for preventing excessive pressure build-up from occuring in the first or second compression cylinders due to liquid, rather than a gaseous substance, entering either cylinder, so that the liquid may pass therethrough at a safe operating pressure level.

9. The compressor of claim 1, wherein a cooling chamber is provided between the hydraulic power piston and cylinder, and each of the first and second pistons and cylinders, each cooling chamber surrounding a portion of the piston rod and including means for directing air flow from the means for forcing air over the piston rod.

10. The compressor of claim 1, wherein at least one of the compression cylinders is provided with a pipe tapped opening and a clearance bottle is attached thereto, whereby the volume of said cylinder is variable to provide balancing of compression ratios between the first and second compression cylinders.

11. A system as recited in claim 1 wherein said variable displacement hydraulic pump provides constant output throughout the reciprocatory cycle of said reciprocating hydraulic power piston.

12. A hydraulic control and power system for a compressor for gaseous substances having first and second double-acting pistons and compression cylinders and a reciprocating hydraulic power piston and cylinder for actuating the first and second pistons, comprising:

a variable displacement hydraulic pump for providing hydraulic fluid to the power piston and cylinder to reciprocate the power piston within its cylinder;

a two position shuttle valve for alternating the flow of hydraulic fluid from the pump into and out of the ends of the hydraulic power piston cylinder;

a cam-operated, spring loaded check valve associated with each end of the power piston cylinder, said check valves being actuated by the reciprocating motion of the power piston to discharge hydraulic fluid from the respective end of said power piston cylinder;

a pilot valve for actuating the shuttle valve in response to a pressure differential caused by the discharge of hydraulic fluid through one of the cam-operated, spring loaded check valves;

a hydraulic fluid reservoir; and hydraulic fluid piping operatively associating the pump, shuttle valve, check valves, pilot valve and reservoir, with one another, so that upon varying the displacement of the pump, the speed of reciprocation of the power piston is varied, said hydraulic piping including means operatively connecting said check valves and pilot valve, said means consisting of conduits operatively extending from each of said check valves directly to said pilot valve for providing an all-hydraulic control of said pilot valve.

13. The hydraulic control and power system of claim 12, wherein a pressure relief valve is operatively associated with the pump, whereby an excessive pressure build-up within the piping of either compression cylinder is safely relieved.

14. The hydraulic control and power system of claim 12, wherein a bladder accumulator is operatively associated with the pump and piping, whereby pressure shocks caused by reciprocation of the shuttle valve are absorbed, and pump energy is stored during the time required to switch the shuttle valve.

15. The hydraulic control and power system of claim 12, wherein a pressure compensated flow control valve and distribution block are operatively associated with the pump and piping to provide lubricating hydraulic fluid to the compression cylinders and piston rod for the double-acting pistons.

16. The hydraulic control and power system of claim 12, wherein a check valve is operatively disposed in the piping between the pump and the shuttle valve, to prevent pressurized hydraulic fluid which exited from the pump from re-entering the exit side of the pump.

17. The hydraulic control and power system of claim 12, wherein an accumulator and relief valve are disposed in vent piping from the shuttle valve to the reservoir to minimize pressure shocks caused by reciprocation of the shuttle valve.

18. The hydraulic control and power system of claim 11, wherein the pilot valve has a mechanical detent mechanism which holds the pilot valve in position on loss of hydraulic pump flow.

19. A system as recited in claim 12 wherein said variable displacement hydraulic pump provides constant output throughout the reciprocatory cycle of said reciprocating hydraulic power piston.

20. The hydraulic control and power system of claim 12, further comprising, a flow control valve means operatively associated with each end of the shuttle valve to for throttling the hydraulic fluid flowing from the pilot valve to either end of the shuttle valve, so that the response time of the shuttle valve is controlled and hydraulic shocks caused by the shuttle valve moving too quickly are controlled.

21. The hydraulic control and power system of claim 20, wherein the check valves and fluid control valves are each operatively associated with a needle valve for creating a pressure differential to reciprocate the pilot valve.

22. A system as recited in claim 13 wherein said hydraulic fluid piping further comprises: conduit means operatively connecting said variable displacement hydraulic pump output so that the flow of hydraulic fluid from it is regulated by said pilot valve; and piping connecting the fluid whose flow is regulated by said pilot valve to said shuttle valve to control said shuttle valve.

23. A hydraulically powered compressor for elevating the pressure of gaseous substances, comprising:

a first double-acting piston and compression cylinder for compressing the gaseous substance;

a second double-acting piston and compression cylinder for compression of the gaseous substance;

a hydraulic power piston and cylinder disposed between the first and second double-acting pistons and cylinders; the first and second double acting pistons and the hydraulic power piston each being disposed on a common elongated piston rod;

piping for transferring the compressed gaseous substance from the first and second pistons and compression cylinders to an exit orifice;

cooling coils respectively associated with the piping for cooling the compressed gaseous substance;

means for forcing air to flow over the cooling coils;

the first and second pistons and compression cylinders, power piston and cylinder, piping, cooling coils, and air forcing means all being disposed within an air-cooling duct to provide cooling thereto; and means for providing infinitely variable capacity control for the first and second pistons and compression cylinders, the capacity control means including a variable displacement hydraulic pump for actuating the hydraulic power piston and cylinder, so that the first and second pistons and compression cylinders may be operated over a range of from 0 to 100% of their capacity.

24. The compressor of claim 23, wherein the first and second pistons and compression cylinders and hydraulic power piston and cylinder are disposed on a mounting plate by means of two mounting bolts, whereby transmission of stress forces to the compression cylinders and power cylinder from the mounting plate is greatly minimized.

25. The compressor of claim 23, wherein the first and second pistons are threadedly affixed in a first direction to the piston rod and are secured to the piston rod by a locking member which is threaded into the piston rod in a second opposite direction.

26. The compressor of claim 23, wherein the means for forcing air includes a fan and hydraulic motor therefor, and the motor has a pressure compensated flow control valve associated therewith operatively connected between the variable displacement hydraulic pump and the motor, so that the fan motor is powered by the variable displacement hydraulic pump, and operates at a constant speed to provide cooling to the first and second cooling coils, first and second pistons and cylinders, and hydraulic power piston and cylinder and to blow out of the air cooling duct any accumulated gaseous substance.

27. The compressor of claim 23, wherein the piston rod is provided with a plurality of rod packings and the variable displacement hydraulic pump is associated therewith to automatically provide lubricating hydraulic oil thereto.

28. The compressor of claim 23, wherein the first and second cylinders are provided with lubrication connections associated with the first and second pistons and the variable displacement hydraulic pump, whereby lubricating hydraulic oil is automatically provided to the interface between the first and second pistons and first and second compression cylinders.

29. The compressor of claim 23, wherein each of the first and second cylinders and the hydraulic power cylinder each engage a header member at the first and second ends of each cylinder, and a seal means is provided on each header member which seal means contacts the internal surface of each cylinder.

30. The compressor of claim 23, wherein a pressure relief valve is associated with the hydraulic variable displacement pump and first and second compression cylinders, whereby excessive pressure build-up is prevented from occuring in the first or second compression cylinders due to liquid, rather than a gaseous substance, entering either cylinder, so that the liquid may pass therethrough at a safe operating pressure level.

31. The compressor of claim 23, wherein a cooling chamber is provided between the hydraulic power piston and cylinder, and each of the first and second pistons and cylinders, each cooling chamber surrounding a portion of the piston rod and including means for directing air flow from the means for forcing air over the piston rod.

32. A system as recited in claim 23 wherein said variable displacement hydraulic pump provides constant output throughout the reciprocatory cycle of said reciprocating hydraulic power piston.

* * * * *